United States Patent [19]

Shigeura et al.

[11] Patent Number: 4,747,627

[45] Date of Patent: May 31, 1988

[54] APPARATUS FOR IMPROVING ADHESION OF A RAILWAY VEHICLE

[75] Inventors: Junichi Shigeura; Nobuyoshi Takahashi; Noriyuki Isoda, all of Hyogo, Japan

[73] Assignee: Mitsubishi Denki Kabushiki Kaisha, Tokyo, Japan

[21] Appl. No.: 913,280

[22] Filed: Sep. 30, 1986

[30] Foreign Application Priority Data

| | | | |
|---|---|---|---|
| Sep. 30, 1985 | [JP] | Japan | 60-219400 |
| Apr. 14, 1986 | [JP] | Japan | 61-85787 |
| May 21, 1986 | [JP] | Japan | 61-116700 |
| May 21, 1986 | [JP] | Japan | 61-116701 |

[51] Int. Cl.[4] ..... B61C 15/10

[52] U.S. Cl. ..... 291/3; 291/19; 291/46; 239/290; 239/424

[58] Field of Search ..... 291/1, 3, 11 R, 11 A, 291/13, 19, 20, 23, 41, 46; 51/439; 239/290, 424

[56] References Cited

U.S. PATENT DOCUMENTS

| | | | |
|---|---|---|---|
| 549,642 | 11/1895 | Heysinger | 291/1 |
| 1,026,688 | 5/1912 | MacLeod et al. | 291/11 R X |
| 1,404,903 | 1/1922 | Spencer | 291/3 |
| 2,654,622 | 10/1953 | Foster | 291/19 X |
| 2,783,070 | 2/1957 | Saari et al. | 291/11 R |
| 3,020,071 | 2/1962 | Makinson | 291/11 R |
| 3,123,386 | 3/1964 | Frantz | 291/11 R |
| 4,412,402 | 11/1983 | Gallant | 51/439 |

FOREIGN PATENT DOCUMENTS

| | | | |
|---|---|---|---|
| 2556351 | 7/1977 | Fed. Rep. of Germany | 291/1 R |
| 2911075 | 9/1980 | Fed. Rep. of Germany | 291/19 |
| 1387451 | 3/1975 | United Kingdom . | |
| 0783086 | 11/1980 | U.S.S.R. | 291/3 |

*Primary Examiner*—Johnny D. Cherry
*Assistant Examiner*—Scott H. Werny
*Attorney, Agent, or Firm*—Sughrue, Mion, Zinn, Macpeak & Seas

[57] ABSTRACT

A sanding apparatus improves adhesion between a rail-car wheel and a rail by supplying adhesion intensifying particles to the contact faces. Sand and/or quartz particles, having diameters such that at least 50% of the particles are 100 to 300 micrometers, are mixed with compressed air and jetted at high velocity through a U-shaped storage chamber, out a nozzle, to the wheel-rail contact area. In the nozzle, a compressed air supply pipe surrounds and projects beyond the end of the particle supply pipe to create an air curtain surrounding the jetted particles. A heater, a heat insulation member, or constantly leaking air may be used to prevent freezing in the pipes.

12 Claims, 5 Drawing Sheets

APPARATUS FOR IMPROVING ADHESION OF A RAILWAY VEHICLE

BACKGROUND OF THE INVENTION

1. Field of the Invention

The present invention relates to a method and apparatus for improving adhesion in a railway vehicle by increasing the adhesion coefficient between the rail and a wheel of the railway vehicle.

FIG. 1 shows an improved adhesion device for a railway vehicle which is described in Japanese Laid-open Patent Application No. (OPI) 60-163703. The figures shows a railway wheel 1, a rail 2, and a bogie or carriage 3. A container 4 supported on the bogie 3 contains minute adhesion particles 8. A pipe 5 is provided on the container 4 so as to supply the adhesion particles 8 to a contact surface defined between the wheel 1 and the rail 2. The adhesion particles 8 may be sand or quartz. The pipe 5 has an opening positioned in front of the wheel 1 in the normal running direction of the vehicle and in confrontation with the contact surface between the wheel 1 and the rail 2.

Further, a second pipe 6 is juxtaposed with the first pipe 5 for applying weak pneumatic pressure upon actuation of an electro-magnetic valve 7 so as to direct the minute particles 8 toward the contact surface.

Incidentally, the minute adhesion particles 8 have a particle diameter of 10 to 100 micrometers.

In the conventional adhesion intensifying method applied to railway rolling stock, jets of fine particles of 10–100 micrometers in particle diameter are sent out to the contacting faces of wheels and rails with the aid of weak air pressure. Such a conventional method has a shortcoming in that the particle may be unable to properly reach an intended spot because the trajectory in which the particles flow is curved when vehicles in operation are subjected to a side wind or when turbulent air is generated as the vehicles move.

Another drawback is that the pipe may become clogged with frozen moisture stuck to the interior of the pipe or mingled with the fine particles. The frozen moisture results in impeding the injection of the fine particles.

Since the conventional adhesion intensifier for railway rolling stock is thus constructed, a fixed quantity of sand is jetted out, irrespective of the speed of rotation of the wheel, and more sand than is required is consumed when the vehicle speed is low. On the other hand, insufficient sand is delivered when the vehicle speed is high resulting in a reduction in the coefficient of adhesion. Another problem is that, since a fixed quantity of sand is jetted out, irrespective of the weather conditions, of the conditions of the roadbed or of the load carried by the vehicle, an excess or insufficient quantity of sand may be delivered for those conditions.

SUMMARY OF THE INVENTION

The present invention has been made in order to solve the above-mentioned problems.

Accordingly, it is an object of the present invention to provide a method for improving adhesion in railway vehicles and which is capable of minimizing distortions in the area to which the adhesion improving particles are injected in the presence of a transverse wind.

It is another object of the invention to provide an adhesion intensifier for railway rolling stock which is capable of reducing the variations in the trajectories of particles projected through the air even when a side wind blows against the vehicles.

Yet another object is to prevent the pipe of the adhesion apparatus from freezing.

It is still another object of the invention to provide a method for intensifying the adhesion of railway rolling stock by supplying a suitable quantity of adhesion particles.

In the present invention, adhesion improving particles are injected together with air at high velocity toward the area between a wheel and a rail.

The method for intensifying adhesion according to the present invention comprises controlling the quantity of body particles being jetted out according to vehicle operating conditions.

In the adhesion intensifier according to the present invention, a first duct (particle supply pipe) is coupled to a storage chamber containing body particles. A second duct (compressed air supply pipe) having a sectional area larger than that of the first duct is so arranged as to envelop the first duct and project from the first duct, whereby compressed air is jetted out of the second duct.

Moreover, an anti-freezing means at least envelops the compressed air supply pipe.

In the present invention, the adhesion improvement can be enhanced, since the adhesion improving particles reliably reach the area between the wheel and the rail.

The method for intensifying adhesion according to the present invention ensures the supply of a suitable quantity of adhesion particles at all times because the quantity of particles being jetted out is controlled according to the operating conditions such as the speed of rotation of a wheel, the conditions of the road bed, etc.

In the adhesion intensifier according to the present invention, compressed air is supplied to the compressed air supply pipe when jets of adhesion particles are sent out. In this case, the particles are led from the storage chamber to the powder supply pipe by the viscous coupling with air and by the difference in pressure with which the jets of particles are sent out because the particle supply pipe and the compressed air supply pipe are different in length. Furthermore, the jets of particles are transported to the place where there is the difference in length between the particle supply pipe and the compressed air supply pipe. Since the compressed air supply pipe for the compressed air is formed outside the particle supply pipe for allowing the body particles to pass therethrough, the adhesion particles are properly supplied to the intended target at the contacting faces of the wheel and the rail without scattering by the effect of a compressed air curtain derived from the above double-duct construction.

Moreover, the anti-freezing means prevents the insides of both ducts from freezing to ensure the smooth injection of the body particles.

BRIEF DESCRIPTION OF THE INVENTION

DESCRIPTION OF THE PREFERRED EMBODIMENTS

Figure 1:
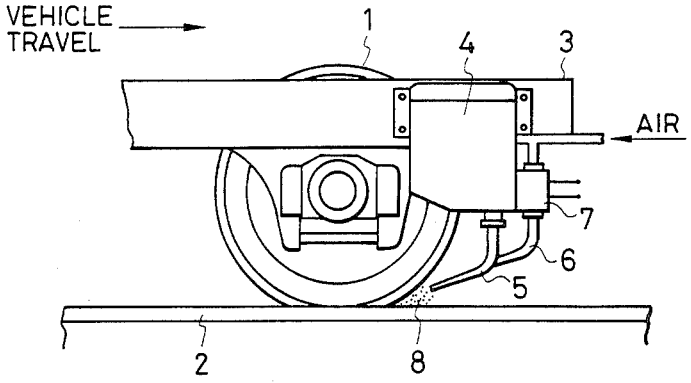
FIG. 1 PRIOR ART
FIG. 1 is an illustration showing a conventional adhesion improving apparatus.
Figure 2:
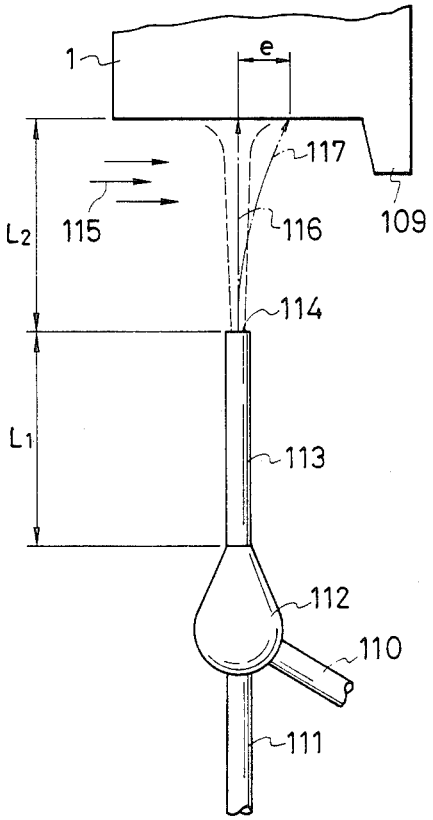
FIG. 2 is a general illustrative diagram of one embodiment of this invention.

An embodiment according to the present invention will be described with reference to the accompanying drawings. First the invention will be described generally. FIG. 2 shows a cross-section of a wheel, identical to that shown in FIG. 1, and a guide flange 109 of the wheel 1. A pipe 110 supplies adhesion improving particles. The adhesion improving particles may be sand or quartz or a mixture of sand and quartz, in which 50 percent of the particles have particle diameters in the range of 100 to 300 micrometers. In case the mixture of sand and quartz is used, the particle diameter of the sand can be selected to be in the range from 100 to 500 micrometers. The reason for the wider range for sand is that size of the quartz particle will be finally determinative since the sand is readily crushed in comparison with the quartz particles. A compressed air supply pipe 111 is provided for supplying compressed air at a predetermined pressure. The particle supply pipe 110 and the compressed air supply pipe 111 are connected to a mixing chamber 112. In the mixing chamber 112, the adhesion improving particles and the air are mixed with each other at a predetermined rate. An injection pipe 113 is connected to the mixing chamber 112 and is provided at its end with an injection opening 114. The injection pipe 113 has an axial length $L_1$. A fluidized mixture provided by mixing the adhesion improving particles and the air in the mixing chamber 112 is injected from the injection opening 114 to the area between the wheel 1 and the rail. The direction of a transverse wind is shown by arrows 115, and the injecting direction of the adhesion improving particles is shown by an arrow 116. A trajectory 117 of the adhesion improving particles is shown when the particles are subjected to the transverse wind 115. The distance between the injection opening 114 and the target point is designated by $L_2$.

With the structure described above, upon instruction, compressed air and adhesion improving particles are supplied from the compressed air supply pipe 111 and particle supply pipe 110, respectively, and these are mixed with each other in the mixing chamber 112. The fluid mixture is injected at high velocity from the injection opening 114 of the injection pipe 113 to the area between the wheel 1 and the rail. In this case, the distance $L_2$ between the injection opening 114 and injection target point is suitably determined so as to prevent the adhesion improving particles from being largely displaced away from the injecting direction 116.

Figure 3:
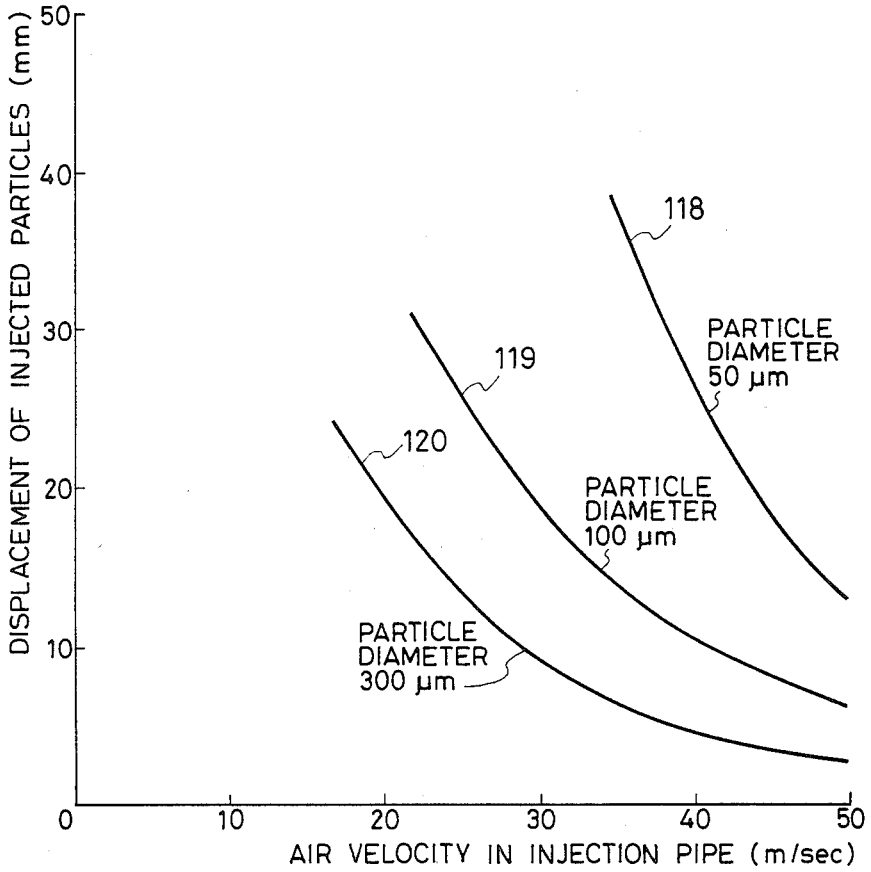
FIG. 3 is an explanatory diagram showing the influence of adhesion improving particles injected at predetermined velocity when transverse wind is applied to the particles.

Next, the relationship will be described between the velocity of compressed air and the particle diameter of the adhesion improving particles (sand) in the presence of a transverse wind whose wind velocity is 10 m/sec. In FIG. 3, the horizontal axis represents air velocity, and the vertical axis represents the displacement length ("e" in FIG. 1) away from the injecting direction 116 during travel of the adhesion improving particles along a length $L_2$ of 150 mm. Curves 118, 119 and 120 show the results with respect to the use of sand having diameters of 50 micrometers, 100 micrometers and 300 micrometers, respectively.

As is apparent from the above, if the particle diameter is less than 100 micrometers, the particle trajectory is excessively deflected.

Further, the coefficient of rolling adhesion with respect to sand and quartz as determined by adhesion testing apparatus is shown in the following table. In this case, particles were used for which not less than 50% of particles have diameters of 100 to 300 micrometers.

| condition | adhesion improving particles (micrometers) | average coefficient of rolling adhesion |
|---|---|---|
| water | sand (100–300) | 0.450 |
| | quartz particles (100–300) | 0.516 |
| | not used | 0.206 |

In view of the foregoing, the following can be concluded:

1. Particle diameter of not less than 50% of the adhesion improving particles should be 100 to 300 micrometers.

2. The adhesion improving particles should be mixed with air which flows through the injection pipe at a flow velocity of not less than 30 m/sec.

3. The adhesion improving particles should comprise silica sand or quartz or mixtures thereof. In the case of mixtures, particularly where the sand is less than 50% by weight, the particle diameter of the sand can be selected in the range of from 100 to 500 micrometers since the particle diameters of the quartz is determinative in the present invention for the reason that the quartz hardness is higher than the sand hardness, and sand is easily crushed in comparison with the quartz. In no case should the particle diameter exceed 1/10 of the diameter of the jetting pipe.

4. In order to minimize dispersion of the injected adhesion improving particles, as mentioned later, an outer pipe having a size larger than that of the injection pipe is disposed over the injection pipe, and an air curtain is provided by injecting air from a space defined between the injection pipe and the outer pipe, so that the adhesion improving particles surrounded by the air curtain can reach the target point.

5. The injection opening should be directed along a direction perpendicular to the wheel tread, or should be directed with an angular orientation along the direction opposed to the guide flange of the wheel.

Incidentally, the railway vehicle is often constructed in such a manner that return electric current flows from the wheel to the rail. In such case, the adhesion improving particles comprises a mixture of insulative particles and conductive particles, so that the electrical resistance can be reduced.

Figure 4:
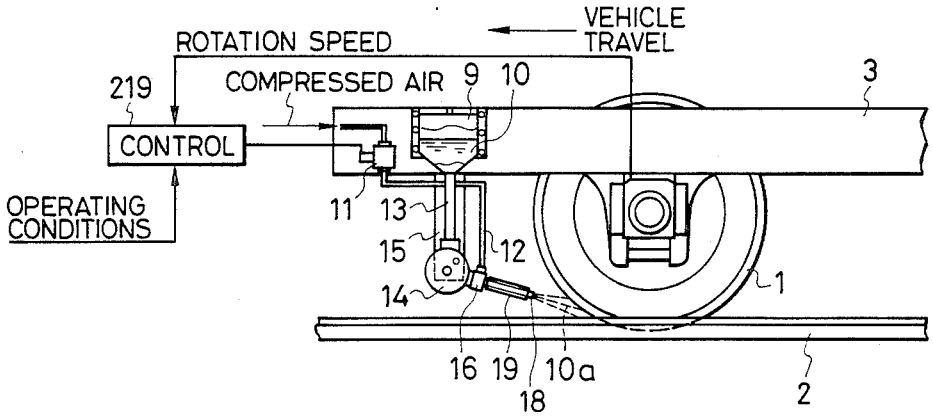
FIG. 4 is a detailed illustrative drawing of the embodiment of the present invention.
Figure 5:
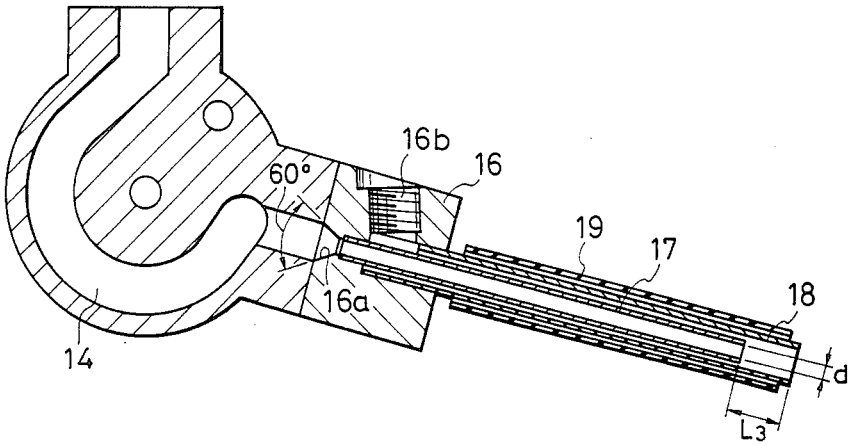
FIG. 5 is a sectional view showing the principal portion of FIG. 4.

Next, a specific embodiment of the present invention will subsequently be described. In FIGS. 4 and 5, the wheel 1, the rail 2 and the bogie 3 are the same components as those described in reference to the conventional construction. Adhesion particles 10 are contained in a storage container 9. Sand, quartz or a mixture of sand and quartz capable of improving adhesion is used as the adhesion particles 10. The particle diameters range from 100 micrometers to 500 micrometers. The embodiment of the present invention further includes a solenoid valve 11 for controlling the supply of compressed air. An air supply pipe 12 supplies the compressed air. A transport pipe 13, connected to the storage container 9, transports the adhesion particles 10. A U-shaped storage chamber 14 (see FIG. 5) is fixed to the bogie 3 through a mounting plate 15 and is connected to the storage container 9 through the transport pipe 13. A coupling member 16 has, as shown in FIG. 5, a first through-hole 16*a* with one end which opens at an angle of 60° toward and which is coupled to the U-shaped storage chamber 14. This angle, in any case, should be less than 90°. The coupling member 16 has a second through-hole 16*b* communicating with the first through-hole 16*a* and connected to the air supply pipe 12. A particle supply pipe 17 has one end coupled to the U-shaped storage chamber 14 through the coupling member 16. A compressed air supply pipe 18 is connected to the second through-hole 16*b* of the coupling member 16 and envelopes the particle supply pipe 17. The compressed air supply pipe 18 projects from the front end of the particle supply pipe 17 by a distance $L_3$ of 7.5 mm to 20 mm. An anti-freezing means 19 in the form of a heater or a heat insulation member envelopes the compressed air supply pipe 18. A control device 219 such as a switch controls the switching operation of the solenoid valve 11.

In the adhesion intensifier thus constructed, since the particle supply pipe 17 is inclined at a shallow angle, the adhesion particles 10 stored in the storage chamber 14 remain static when the solenoid valve 11 is closed, i.e., no compressed air is supplied to the compressed air supply pipe 18.

A description will now be given of the operation in which jets of adhesion particles 10 are sent out. The solenoid valve 11 is first excited and opened to cause the compressed air to jet out of the compressed air supply pipe 18 through the air supply pipe 12. By the effect of viscosity and the pressure difference of the air jetted out of the tip of the compressed air supply pipe 18, the adhesion particles 10 in the storage chamber 14 are caused to pass through the particle supply pipe 17 and to jet out together with the compressed air. Since the compressed air from the compressed air supply pipe 18 is kept jetting around the front end of the particle supply pipe 17 in that case, the effect of the compressed air curtain allows the adhesion particles 10 to reach the contacting faces of the wheel 1 and the rail 2 in the form of jets of particles 10*a* shown in FIG. 4 without scattering. Given that a 0.5 mm–1.5 mm space is provided between the powder supply pipe 17 and the compressed air supply pipe 18 and that the compressed air has a pressure of 5 kg/cm$^2$, the propellent velocity of the jets of body particles is 200–300 m/sec. In order to stop the jets of particles 10 from being sent out, it is only necessary to stop the supply of the compressed air to the compressed air supply pipe 18.

Moreover, the jets of body particles can reliably be sent out by actuating the anti-freezing means when the adhesion intensifier is operated in low-temperature areas in which the apparatus would otherwise be frozen.

Figure 6:
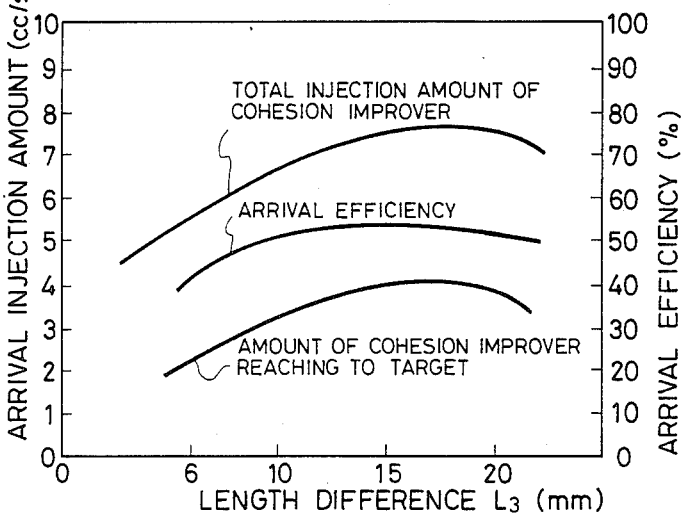
FIG. 6 is a graph explanatory of the relation of the difference in length $L_3$ between the front ends of both supply pipes to the injection quantity, the quantity of particles arriving at a target and the arrival efficiency.

The chart of FIG. 6 shows data on how the difference in length $L_3$ between the front ends of the particle supply pipe 17 and the compressed air supply pipe 18 affects the injection volume (cc/sec) and the arrival efficiency when the inner diameter of the particle supply pipe 17 is set at 3 mm and the space between the powder supply pipe 17 and the compressed air supply pipe is set at 1 mm. The arrival efficiency is represented by the ratio of the quantity of adhesion particles which arrive at a target 50 mm in diameter and separated by 250 mm from the front end of the compressed air supply pipe 18 to the total quantity thereof jetted out of the particle supply pipe 17. In view of the arrival efficiency, the difference in length between the injection pipes at their front ends should preferably be 7.5 mm–25 mm. When the inner diameter of the particle supply pipe 17 is set at d (mm), such a difference in length $L_3$ between the supply pipes at their front ends should be so arranged as to satisfy $L_3=(3-8)\times d$, that is, a difference of three to eight times the diameter.

Figure 7:
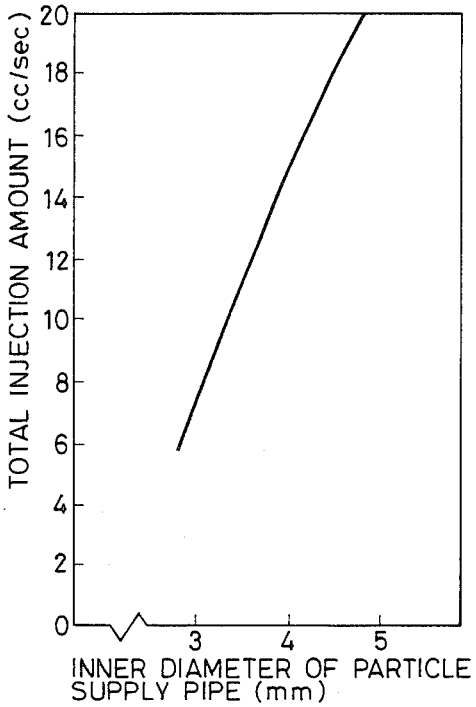
FIG. 7 is a graph explanatory of the relation between the inner diameter of the particle supply pipe and the total injection quantity.

The graph of FIG. 7 shows the total injection volume (cc/sec) when the inner diameter of the powder supply pipe 17 is varied with a space of 1 mm provided between the particle supply pipe 17 and the compressed air supply pipe 18. As shown in the graph of FIG. 7, the total injection volume is 7.5 cc/sec when the inner diameter of the particle supply pipe 17 is set at 3 mm. Since the arrival efficiency is about 50% as shown in FIG. 3, about 3.8 cc/sec of particles arrive at the contacting faces of the wheel 1 and the rail 2, provided that the front end of the compressed air supply pipe 18 is placed 250 mm apart from the contacting faces of the wheel 1 and the rail 2.

It takes 0.1 sec or less for the adhesion particles to reach the contacting faces of the wheel 1 and the rail 2 after the solenoid valve 11 is excited according to the above embodiment of the present invention.

Although the anti-freezing means for use in enveloping the compressed air supply pipe 18 was described in the above embodiment, the compressed air supply pipe 18 can also be prevented from freezing by constantly leaking from the compressed air supply pipe 18 a small quantity of heated compressed air or air which is kept at normal temperatures. Either the solenoid valve 11 can be left partially open or it can be bypassed by a value-controlled smaller passage.

The anti-freezing effect may also be achieved by sending a jet of warm air for car heating or steam to the whole body of the adhesion intensifier.

Figure 8:
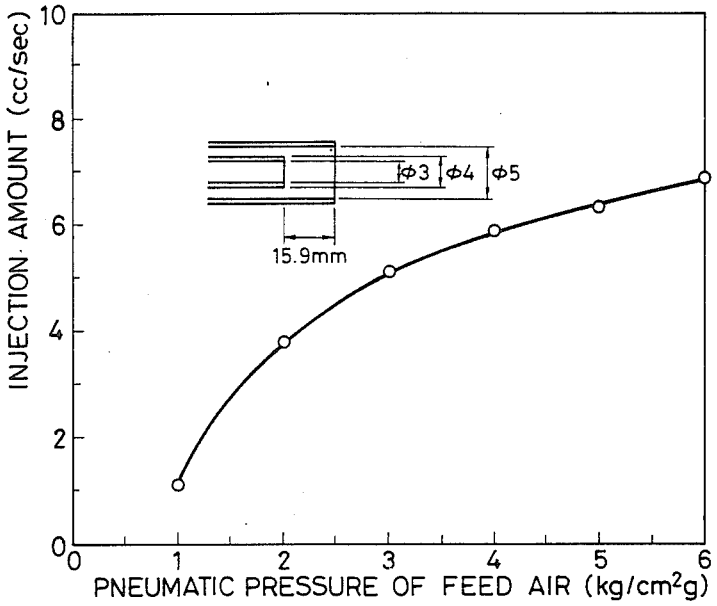
FIG. 8 is a graph explanatory of the relation between the pressure of the air supplied and the injection quantity.

FIG. 8 shows the relation of the pressure of the compressed air supplied to the compressed air supply pipe 18 to the quantity of adhesion particles being jetted out. As is apparent, the injection quantity can be controlled by changing the air pressure.

Figure 9:
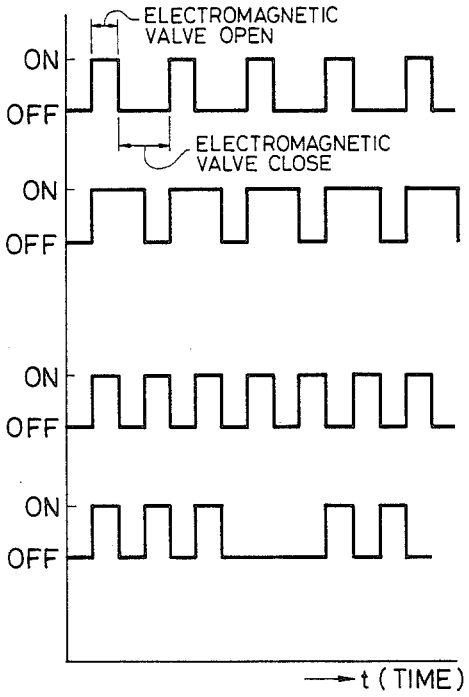
FIG. 9 is a diagram explanatory of the switching of the solenoid valve of FIG. 4.

As shown in FIG. 9, the injection quantity can be controlled by the control device 219, which instructs the solenoid valve 11 to open or close by means of signals produced thereby. Tests carried out using solenoid valves sold on the market proved that a stable quantity of body particles was jetted out 0.1 sec after the "open" instruction was given to the solenoid valve. Accordingly, it is possible to control and stabilize the injection quantity by setting the "open" time at 0.2 sec or longer.

In consequence, the quantity of body particles being jetted out can be controlled by detecting the speed of rotation of the wheel and letting the control device 219 send a signal corresponding to the speed detected through the method shown in FIG. 9. As shown in FIG. 9, further, an electromagnetic proportional control type solenoid valve may be used in place of the on-off control type solenoid valve 11 to control the quantity of compressed air in proportion to variations in electric charges applied to the solenoid valve in order to achieve the same effect.

Although reference was made to the control of the quantity of body particles being jetted out in proportion to the speed of rotation of the wheel according to the above embodiment, the injection quantity may be controlled depending on the conditions of weather or a permanent way, or the vehicle load.

The control device 219 is intended to control the quantity of the jetted particles according to the operating conditions. The vehicle's speed may be detected by a rotational rate detector attached to the axle of the wheel 1 or to other wheels of the train. Temperature can be measured by a thermometer, in order to actuate, the anti-freezing means. Also these and other operating conditions, such as rain, wind, roadbed conditions, load and grade may be input by the train engineer.

According to the present invention, adhesion improving particles can be effectively projected to the target point even if these are subjected to transverse wind pressure, since the particles are injected together with compressed air at high velocity to a portion between the wheel and rail.

Since the quantity of adhesion particles being jetted out is so controlled as to correspond to operating conditions, no excess or deficiency in the quantity of body particles is incurred, which ensures operation with a suitable coefficient of adhesion.

Jets of body particles are sent out in such a state that they are enclosed in a compressed air curtain, so that the body particles are supplied to the contacting faces of the wheel and the rail properly without being scattered. Moreover, since the compressed air supply pipe is enveloped with the anti-freezing means, the efficient injection of freeze-free body particles is assured at all times even in cold districts.

We claim:

1. An apparatus for supplying adhesion intensifying particles to contacting faces of a wheel and rail, comprising:

a supply of adhesion intensifying particles, said particles comprising a material selected from the group consisting of silica sand, quartz and a mixture of silica sand and quartz, a diameter of at least 50% of said particles being within a range of 100 to 300 micrometers;

a U-shaped storage chamber having an upper end of one leg of the U coupled to said supply of particles;

a nozzle, said nozzle comprising an inner particle supply pipe surrounded by an outer compressed air supply pipe, said particle supply pipe having one end coupled to an upper end of the other leg of the U of said storage chamber, one end of said compressed air supply pipe projecting beyond the other end of said particle supply pipe by a distance within a range of 3 to 8 times an inner diameter of said particle supply pipe, a gap between said particle supply pipe and said air supply pipe being in a range of 0.5 to 1.5 mm; and a source of compressed air coupled to the other end of said air supply pipe, a pressure of said compressed air being such that a velocity of particles jetted by said nozzle is in a range of 200 to 300 m/sec.

2. The adhesion intensifying particle supplying apparatus of claim 1, wherein said particles comprise a mixture of silica sand and quartz, silica sand being present in an amount of less than 50%, and a particle diameter of said sand being in a range of 100 to 500 micrometers.

3. The adhesion intensifying particle supplying apparatus of claim 1, where said diameter of said particles is less than 1/10 of a diameter of said particle supply pipe.

4. The adhesion intensifying particle supplying apparatus of claim 1, wherein said nozzle is positioned to jet said particles in a direction of a rail.

5. The adhesion intensifying particle supplying apparatus of claim 1, wherein said nozzle is positioned to jet said particles toward a guide flange of a wheel.

6. The adhesion intensifying particle supplying apparatus of claim 1, wherein said particles comprise a mixture of conductive and nonconductive particles.

7. The adhesion intensifying particle supplying apparatus of claim 1, further comprising means for preventing particles in said particle supply pipe and said air supply pipe from freezing.

8. The adhesion intensifying particle supplying apparatus of claim 7, wherein said freezing preventing means comprises heating means disposed around said nozzle.

9. The adhesion intensifying particle supplying apparatus of claim 7, wherein said freezing preventing means comprises means for injecting a reduced pressure of air through said air supply pipe.

10. The adhesion intensifying particle supplying apparatus of claim 1, wherein said distance by which said one end of said compressed air supply pipe projects beyond the other end of said particle supply pipe is within a range of 7.5 to 25 mm.

11. The adhesion intensifying particle supplying apparatus of claim 1, wherein an angle of an opening between said supply chamber and said one end of said particle supply pipe is less than 90°.

12. The adhesion intensifying particle supplying apparatus of claim 11, wherein said angle of said opening is substantially 60°.

* * * * *